United States Patent [19]

Balogh

[11] Patent Number: 5,007,362

[45] Date of Patent: Apr. 16, 1991

[54] PORTABLE OUTRIGGER ASSEMBLY

[76] Inventor: Mark A. Balogh, Star Rte., P.O. Box 79, Cedar Island, N.C. 28520

[21] Appl. No.: 477,636

[22] Filed: Feb. 9, 1990

[51] Int. Cl.[5] ..... B63B 43/14

[52] U.S. Cl. ..... 114/123; 114/345

[58] Field of Search ..... 114/61, 39.1, 345, 283, 114/347, 123, 267, 39.2; 441/129, 130, 74

[56] References Cited

U.S. PATENT DOCUMENTS 4,136,414 1/1979 Popkin ..... 114/345

4,641,594 2/1987 Birkett ..... 114/347 X 4,771,722 9/1988 Tihany ..... 114/345

*Primary Examiner*—Ed Swinehart

*Attorney, Agent, or Firm*—Richard E. Jenkins

[57] ABSTRACT

A portable outrigger assembly for use to enhance the stability of a boat. The outrigger assembly comprises an inflatable hull, a tube for supporting the inflatable hull in spaced-apart relationship to a sailboat, and a hull attachment member for securing the inflatable hull to the tube. The hull attachment member includes arms to selectively change the cross-sectional shape of the inflatable hull so as to modify the lift capability thereof as desired.

22 Claims, 6 Drawing Sheets

PORTABLE OUTRIGGER ASSEMBLY

TECHNICAL FIELD

The present invention relates generally to outrigger assemblies for sailboats and the like and more particularly to an inflatable outrigger assembly.

BACKGROUND ART

The field of the prior art discloses that inflatable outrigger hulls are well known in the art. For example, U.S. Pat. No. 3,763,813 to Holtz discloses an inflatable canoe with an inflatable outrigger connected The outrigger is attached to the canoe by means spaced-apart and parallel plastic tubes which are secured within rubber-type holding rings. Also of interest, U.S. Pat. No. 2,794,191 to Gaskouitz discloses a portable outrigger assembly comprising an inflatable tube which is attached adjacent to the side of a small boat by a pair of spaced-apart and parallel bracket arms. A valve is provided for inflating and deflating the stabilizing tube as needed.

Heretofore, however, efforts at providing inflatable outrigger assemblies for sailboats and the like have produced only systems which are heavy and unwieldy in use. In contrast, applicant has discovered a simple and lightweight portable outrigger assembly which is easy to use and provides performance capabilities not heretofore possible.

DISCLOSURE OF THE INVENTION

In accordance with the present invention, applicant provides a portable outrigger assembly designed specifically for use with a sailboat and the like and comprising an inflatable hull and tube means for supporting the inflatable hull in spaced-apart relationship to the sailboat wherein the tube means comprises a tube having a first and second end and adapted to be removably connected to the sailboat at the first end. A hull attachment means is secured to the second end of the tube and removably connected to the inflatable hull for attaching the inflatable hull to the tube. The hull attachment means includes means to selectively change the cross-sectional shape of the inflatable hull so as to modify the lift capability of the hull as desired by the user.

It is therefore the object of the present invention to provide a lightweight and high performance portable outrigger assembly for use with a sailboat and the like.

It is another object of the present invention to provide a portable outrigger assembly for a sailboat and the like which includes an inflatable hull which will inherently adjust to varying loads by changing its three-dimensional shape so as to provide more hydrodynamic lift when greater downward forces are imparted thereto.

It is another object of the present invention to provide an inflatable outrigger hull which can be manually tensioned as desired so as to change the cross-sectional shape thereof to provide, as needed, more or less lift by the hull.

It is yet another object of the present invention to provide a portable outrigger assembly which includes a flexibly mounted inflatable hull which can pivot about the axis of the tube attaching the hull to the sailboat so that dynamic forces applied by the water to the hull will cause it to adjust its angle of incidence to maintain a substantially parallel relationship with the horizontal plane of an ocean or a lake to compensate for the uneven shape of the water surface.

Some of the objects of the invention having been stated, other objects will become evident as the description proceeds, when taken in connection with the accompanying drawings.

BEST MODE FOR CARRYING OUT THE INVENTION

Figure 1:
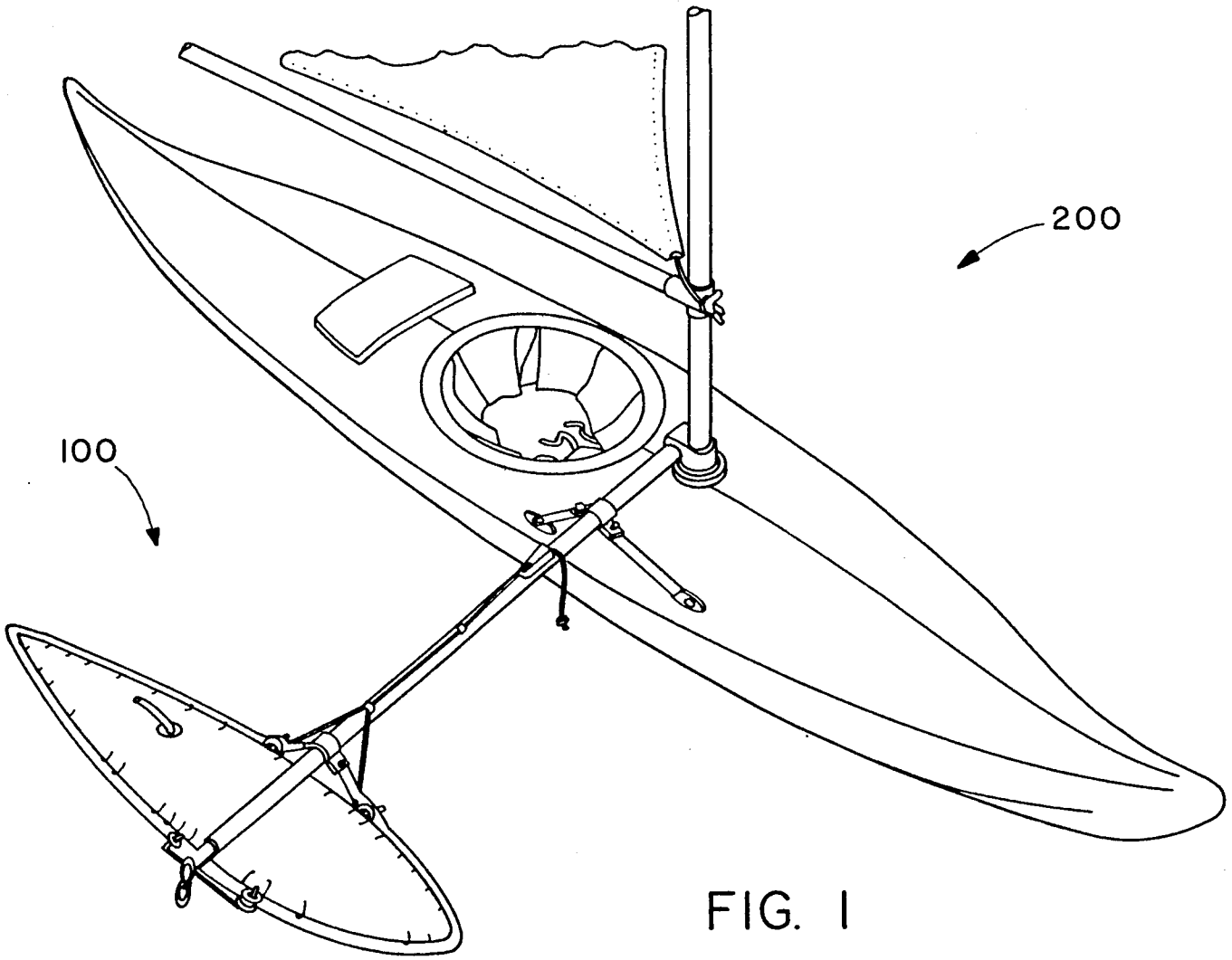
FIG. 1 is a perspective view of a sailboat and the portable outrigger assembly of the present invention.
Figure 2:
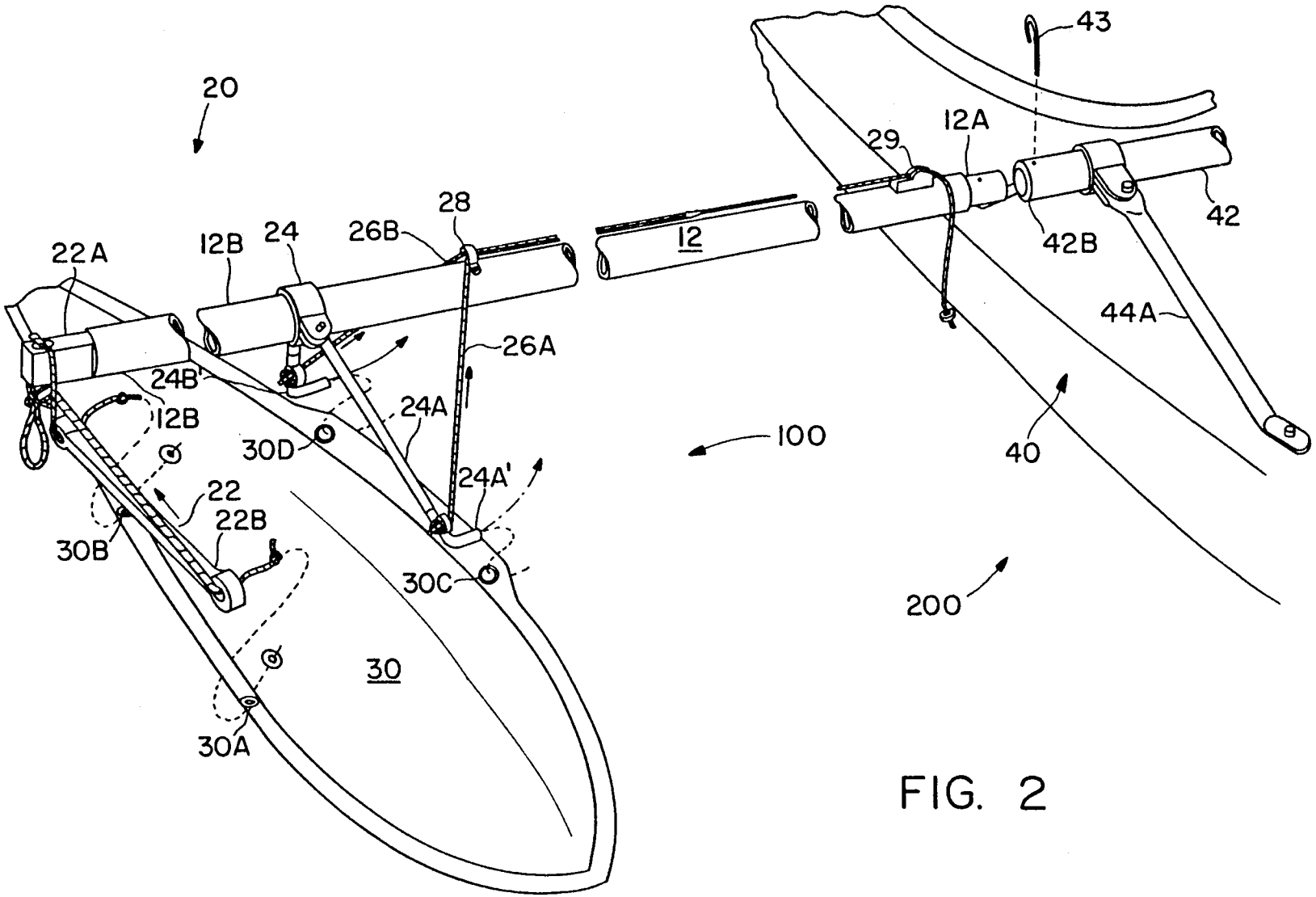
FIG. 2 is an exploded view of the portable outrigger assembly of the present invention.
Figure 3:
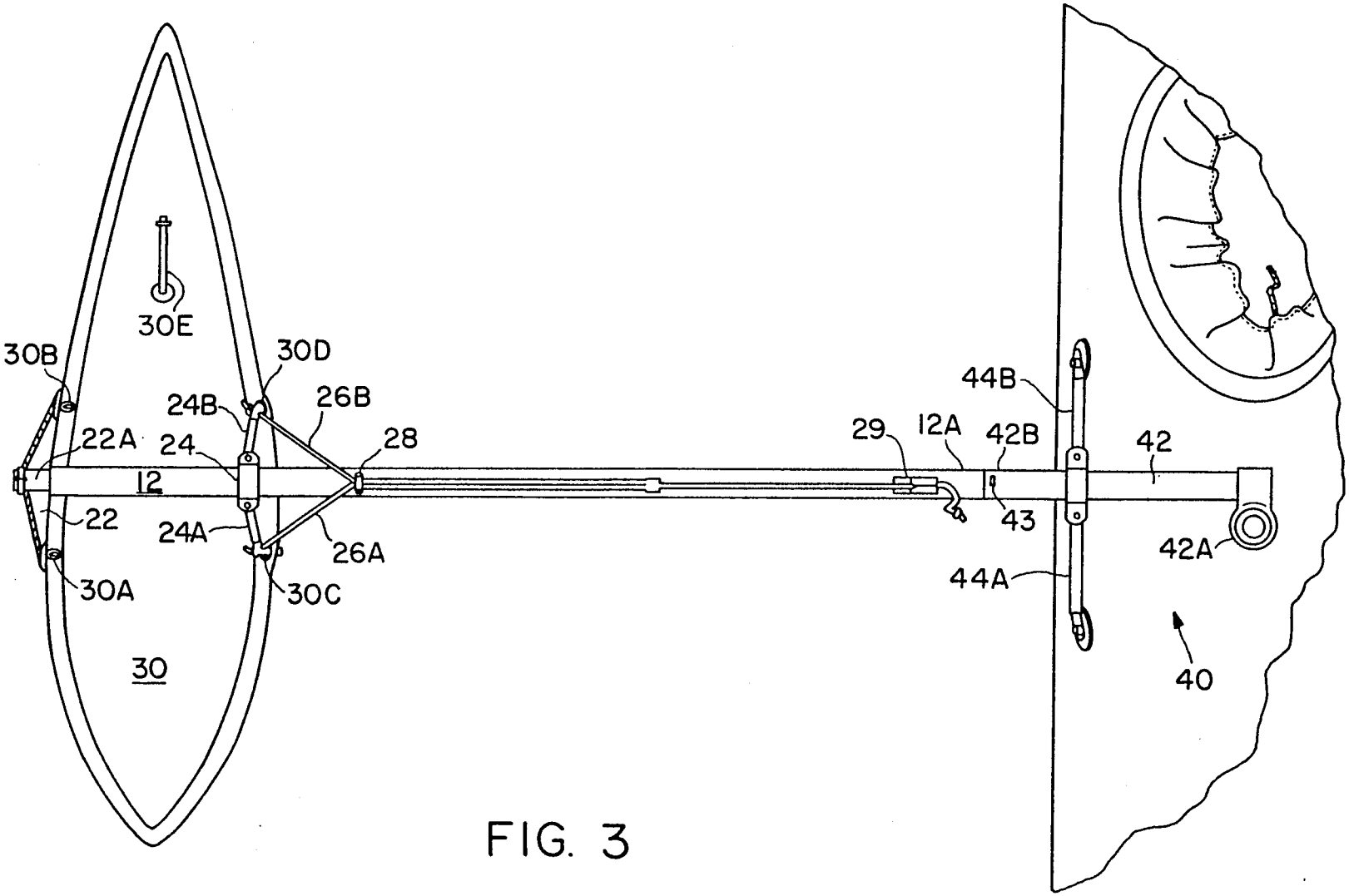
FIG. 3 is a top plan view of the portable outrigger assembly of the present invention.
Figure 4:
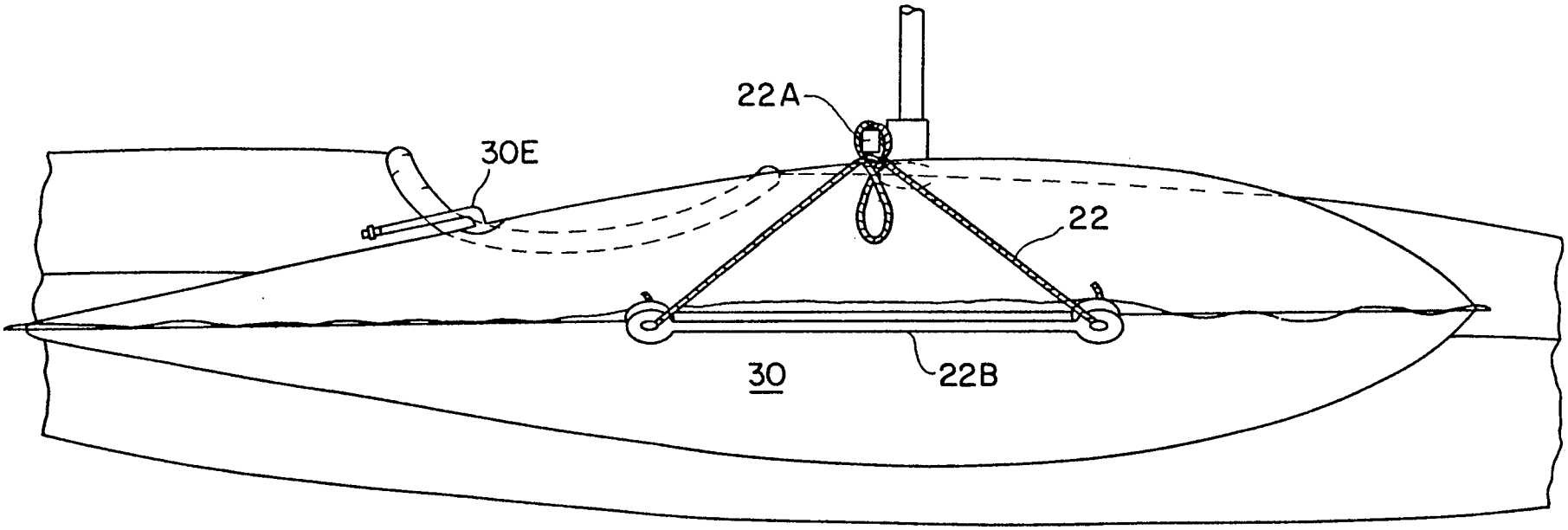
FIG. 4 is an end elevation view of the portable outrigger assembly of the present invention.
Figure 5:
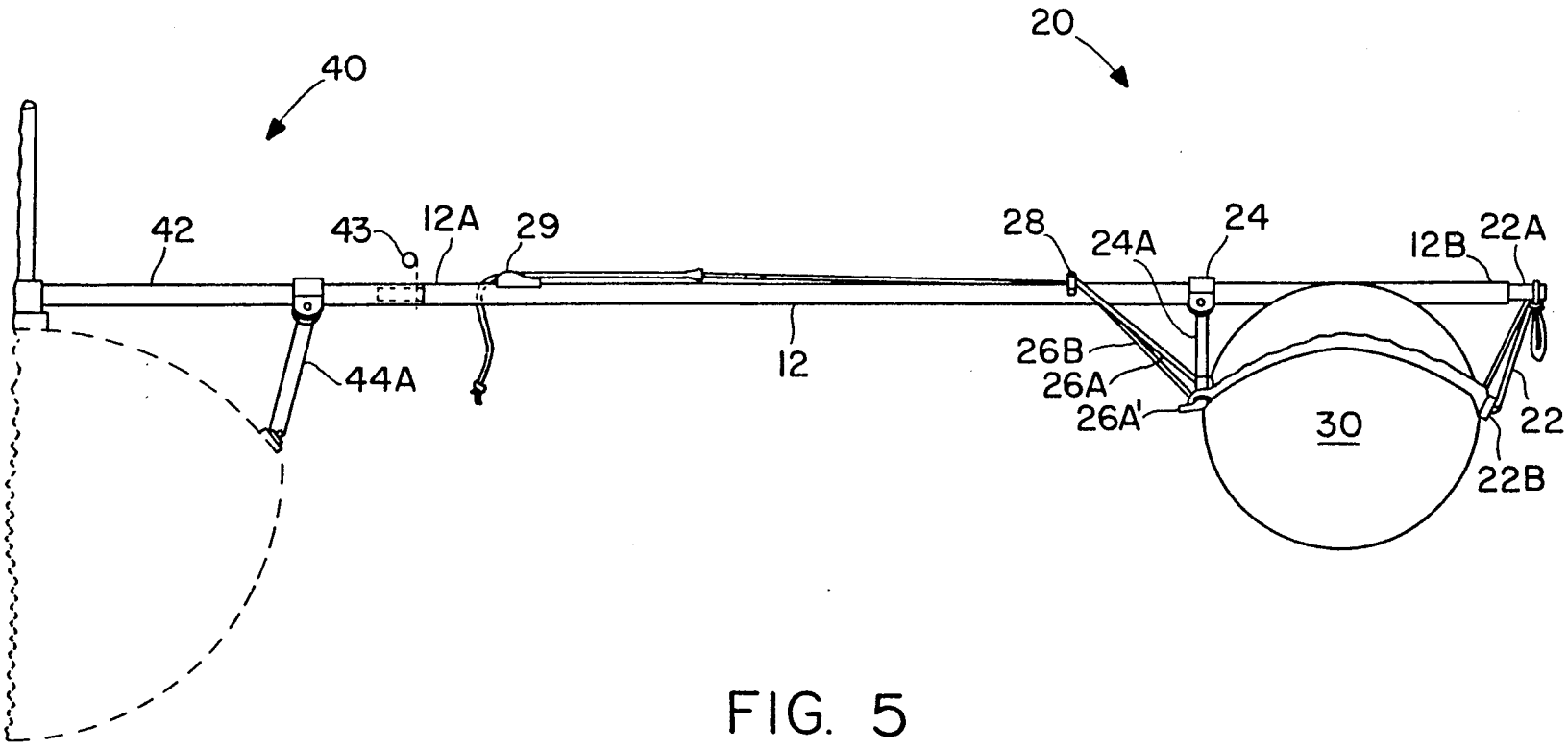
FIG. 5 is a front elevation view of the portable outrigger assembly of the present invention attached to a kayak.

Referring now more specifically to FIGS. 1–6 of the drawings, a portable outrigger assembly 100 is shown connected to sailboat 200 in order to provide stability to the sailboat against the forces of the sail rig. Portable outrigger assembly 100 is specifically designed to provide high stability to sailboat 200 with minimum drag or resistance to forward progress and to further possess characteristics of being very lightweight and easy to disassemble, stow, and reassemble for use.

Generally, portable outrigger assembly 100 comprises a cross tube 12 which is attached at end 12A to a sailboat, kayak, canoe and the like which can advantageously make use of the portable outrigger assembly of the present invention. The other end 12B of tube 12 is used to engage and support inflatable hull 30 with a hull attachment assembly, generally designated 20, which includes a rope bridle 22 for engaging one side of inflatable hull 30 and a pivotable strut assembly 24 including struts 24A and 24B for engaging the other side of inflatable hull 30. Pivotable struts 24A and 24B may be urged toward end 12A of cross tube 12 by corresponding tensioning lines 26A and 26B, respectively, attached thereto and extending through eye strap 28 and secured within cleat 29 located adjacent to tube end 12A.

Continuing the general description of portable outrigger assembly 100 with reference again to FIGS. 1–6, it should be further appreciated that rope bridle 22 is attached to inflatable hull 30 at reinforced apertures 30A, 30B along the side of the hull, and pivotable struts 24A, 24B are attached to the other side of inflatable hull 30 at reinforced apertures 30C, 30D. Although the present invention contemplates providing any suitable support base on a sailboat, kayak, canoe, and the like to which tube 12 is removably connected when portable outrigger assembly 100 is utilized, FIGS. 1–5 depict a support base 40 for matingly receiving cross tube 12 wherein support base 40 comprises tube 42 having one end 42A adapted to slide on and be removably secured to a mast tube and end 42B which will receive tube end 12A therein so that fast pin 43 may be inserted through suitable apertures in cross tube end 12A and support base tube end 42B for securement. Support base tube 42 is fixedly secured adjacent to end 42B to a sailboat, kayak, canoe and the like by suitable fastening means such as support struts 44A, 44B shown in FIG. 2 which are secured to the side of the boat to which support base 40 is attached.

Figure 6:
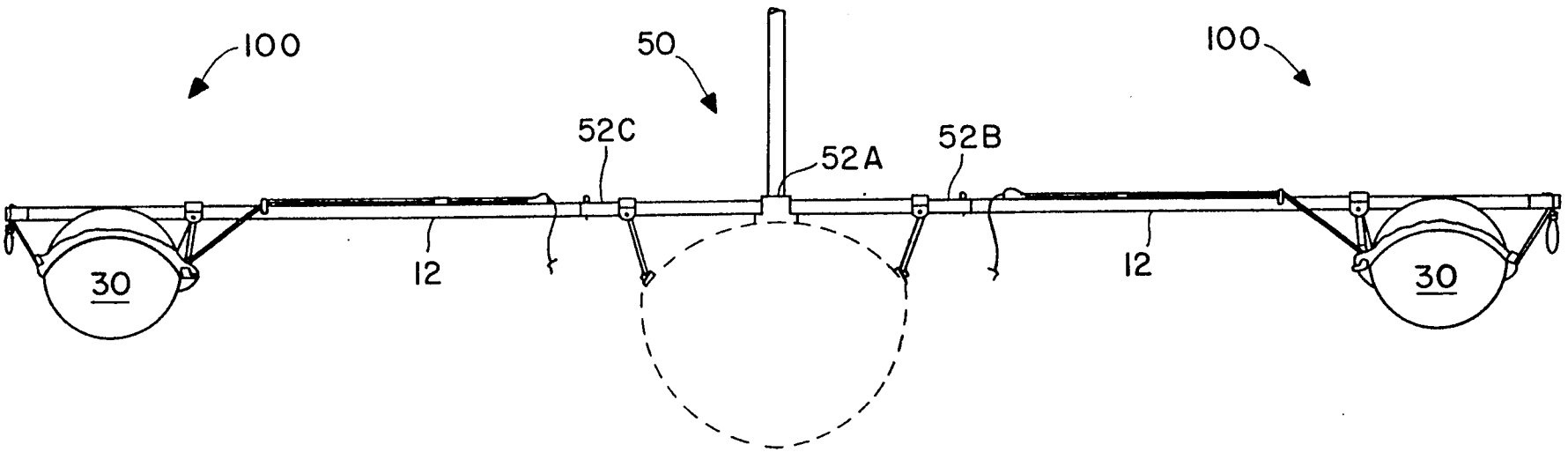
FIG. 6 is a front elevation view of two portable outrigger assemblies according to the present invention attached to each side of a canoe.

FIG. 6 shows the use of two portable outrigger assemblies 100 according to the present invention with a single kayak in order to provide even greater stability thereto. Although substantially identical in assembly to the one outrigger assembly described above, the two outrigger assembly includes a modified support base 50 having a fitting 52A in the middle thereof for slidably receiving and being fastened to a mast tube and opposing ends 52B and 52C for each receiving a respective portable outrigger assembly 100. The use of either one or two of the portable outrigger assemblies 100 of the present invention is a matter of choice by the user, and the benefits and advantages inherent in the present invention are realized with either configuration. Also, any suitable support base can be used to support the outrigger assembly and the exact structure thereof is a matter of design choice.

Having generally described the elements of portable outrigger assembly 100, applicant now wishes to describe each of the aforementioned elements in greater detail so that one skilled in the art will more fully appreciate the advantages of applicant's outrigger assembly over prior art outriggers. Firstly, although the invention contemplates a wide variety of construction materials, preferably cross tube 12 is constructed from aluminum tubing with a 1.375 inch outside diameter along its length and a 1.25 inch outside diameter at end 12A. End 12B of cross tube 12 further includes a plastic masthead fitting 22A defining an aperture therethrough and which is a part of rope bridle 22 described above for engaging one side of inflatable hull 30. Rope bridle 22 also includes as a part thereof compression strut 22B through which the opposite ends of rope bridle 22 are extended to engage apertures 30A, 30B, of inflatable hull 30. More specifically, rope bridle 22, preferably a braided polyester line, passes through masthead fitting 22A and diverges into two ends which then pass through the opposing ends of compression strut 22B and thereafter pass upwardly through apertures 30A, 30B of inflatable hull 30 where each end is knotted on the top side of apertures 30A, 30B. A knot is tied in the middle of rope bridle 22 so that when rigging outrigger assembly 100 and after hull 30 is inflated, the knot is pulled up through the aperture in masthead fitting 22A and then pulled down over the end flange thereof so as to secure the knot beneath masthead fitting 22 so that rope bridle 22 is affixed to cross tube 12 until disassembly of outrigger assembly 100 is required.

With reference now to pivotable strut tubes 24A, 24B, it should be appreciated that the tubes are pivoted toward end 12A of cross tube 12 and aligned therewith when outrigger assembly 100 is disassembled for storage. In use, pivotable strut tubes 24A, 24B are pivoted downwardly so as to extend radially outwardly from cross tube 12. Strut tubes 24A, 24B are preferably constructed of aluminum tubing having a 0.50 inch outside diameter. Each strut 24A, 24B is fitted with a molded plastic end plug, 24A', 24B' respectively, having an aperture extending therethrough. Tensioning lines 26A, 26B, are extended through end plugs 24A', 24B' respectively, and knotted. Lines 26A, 26B, preferably braided nylon or polyester, extend from struts 24A, 24B upwardly through eye strap 28 over the top of cross tube 12 and through cleat 29. End plugs 24A', 24B' of struts 24A, 24B extend through apertures 30C, 30D, respectively, in order to secure the side of inflatable hull 30 opposite that secured by rope bridle 22. As will be explained in more detail below, tensioning lines 26A, 26B may be pulled inwardly toward cross tube end 12A in order to pivot pivotable struts 24A, 24B thereto and modify the cross-section of inflatable hull 30 from a circular cross-section to a more lateral oval-type cross-section as desired when additional lift is desired from outrigger assembly 100.

Inflatable hull 30 is most suitably constructed of 200 Denier or 400 Denier woven nylon fabric which is coated on at least one side with a urethane sealant. Hull 30 further includes a valve 30E for inflating and deflating hull 30 as needed. Although hull 30 may be fabricated in any of a wide variety of manners, preferably inflatable hull 30 is constructed by placing two layers of fabric together and radio frequency (RF) radiation is then utilized to excite the urethane molecules and thereby weld the two halves of hull 30 together. Valve 30E is preferably a molded urethane inflation valve, and apertures 30A–30D are most suitably four (4) molded urethane flange fittings which are also radio frequency (RF) welded between the flange of the two fabric layers forming inflatable hull 30.

Most suitably, inflatable hull 30 measures 54 inches in length along the longitudinal center line, and although the length may vary as a matter of design choice, the width should preferably remain a constant proportion of the length and the terminal ends of hull 30 should have a pointed or conical shape. Most suitably, for any length of inflatable hull 30, the width would be as follows: 1) at 10% length from the bow the width is 17%; 2) at 20% the width is 22.3%; 3) at 30% the width is 23.26%; 4) at 40% the width is 22.56%; 5) at 50% the width is 20.47%; 6) at 60% the width is 17.68%; 7) at 70% the width is 14.19%; 8) at 80% the width is 10.23%; and 9) at 90% the width is 5.35%. Inflatable hull 30 when inflated is generally circular in cross-section and about 8 inches in diameter at 30% of the length back from the bow thereof. Hull 30 has a length-to-width ratio of approximately 6.5 to 1 and a shape generally similar to an elongated water drop that is pointed at each end. Although applicant has described inflatable hull 30 in great detail above, it should be appreciated that the invention is not limited to these construction details and is intended to encompass the use of any type and size of inflatable hull.

Finally, with reference to support base 40 to which cross tube 12 is removably secured by fast pin 43, it should be noted that tube 42 is preferably aluminum tubing having an outside diameter of 1.375 inches and an internal diameter suitable to slidably receive end 12A of cross tube 12. Although not a feature of the present invention, it would be customary for a conventional leeboard (not shown in the drawings) to be pivotably mounted on tube 42 for employment during use of a boat to inhibit the sideways movement thereof due to forces from the sail rig. As a matter of choice, the leeboard may be secured to tube 42 by means of fast pin 43 which also secures cross tube 12 within tube 42 of support base 40. Also, cross tubes 42 and 52 may be suitably secured by conventional struts or gunwale mount brackets to the sailboat, kayak, canoe or the like to which one or two portable outrigger assemblies 100 are secured for stability.

The unique construction of portable outrigger assembly 100 provides not only a strong, lightweight and easy to assemble and disassemble outrigger system, but also a unique ability to manually and automatically adjust the shape of hull 30 to provide for better hydrodynamic efficiency in reacting to varying loads thereon. More specifically, when the downward force on inflatable hull 30 increases, the hull will automatically adjust its three-dimensional shape as well as its attitude in relation to the water's surface to provide more hydrodynamic lift to resist the downward force imparted by the sail rig of a sailboat, etc. The change in shape of hull 30 is primarily due to bending of hull 30 around cross tube 12 that A) flattens and widens the bottom surface of hull 30 to provide more surface area exposed to water so as to increase dynamic lift from water flow past hull 30 and B) increases the angle of incidence between the forward section of hull 30 and the water surface which results in higher fluid pressure on the forward portion of hull 30 in contact with the water and a further increase in dynamic lift, especially in the forward section, which induces hull 30 to lift as it is driven forward. Furthermore, since hull 30 is mounted to cross tube 12 so as to permit some degree of vertical and lateral movement, the pressures from dynamic lift and buoyancy will cause hull 30 to also adjust its angle of incidence with the horizontal plane of the earth's surface to compensate for the uneven shape of the water's surface. This automatic adjustment operates within a range of motion that is influenced by two user controlled adjustments. First, the user can manually adjust the air pressure in hull 30 by means of valve 30E. If the user reduces the air pressure in hull 30, hull 30 becomes more flexible, and an increase in air pressure renders hull 30 less flexible. This manual adjustment influences the bending of hull 30 about cross tube 12 and makes the attachment of hull 30 to cross tube 12 either less or more rigid which also influences the attitude of hull 30 in relation to cross tube 12 and the water surface.

The second manual adjustment for hull 30 involves tensioning lines 26A, 26B which are attached to pivotable struts 24A, 24B secured to apertures 30C, 30D on one side of hull 30. When tensioning lines 26A, 26B are urged toward end 12A of cross tube 12, struts 26A, 26B are urged inwardly toward the hull of the sailboat, and movement of the struts tends to elongate the horizontal cross-section of inflatable hull 30 so as to render it less circular and more oval. Since this adjustment renders the vertical height of the cross-section reduced, hull 30 becomes less resistant to vertical bending and allows for easier bending thereof as described above. Therefore, within the range influenced by the manual adjustments described hereinabove, inflatable hull 30 is self-adjusting. When the downward load thereon is reduced, hull 30 returns to its original shape wherein the waterline width is reduced and results in a smaller frontal area and less drag. Also, since inflatable hull 30 will normally assume a slightly bow-up attitude when unloaded (see FIG. 4), hull 30 when unloaded will assume a front-up attitude and leave less of the wider part and more of the narrower part of the hull in contact with the water which results in a further reduction of frontal area water contact and drag.

The unique manual and automatic adjustment features of hull 30 of portable outrigger assembly 100 allow use of an inflatable hull which is small and light and is thus able to be attached to a sailboat, kayak, canoe and the like with only single cross tube 12. The resulting minimal structure is lightweight and highly efficient when compared to conventional outrigger assemblies known to those skilled in the art.

It will be understood that various details of the invention may be changed without departing from the scope of the invention. Furthermore, the foregoing description is for the purpose of illustration only, and not for the purpose of limitation—the invention being defined by the claims.

I claim:

1. A portable outrigger assembly for a boat such as a kayak, sailboat and canoe comprising:

a. an inflatable hull;

b. support means for supporting said inflatable hull in spaced-apart relationship to said boat and comprising an elongate support arm having a first and second end, said support arm being adapted to be removably connected to said boat at the first end; and c. hull attachment means secured to the second end of said support arm and connected to said inflatable hull for securing said inflatable hull to said support arm, said hull attachment means including means to selectively change the cross-sectional shape of said inflatable hull to modify the lift capability thereof comprising first hull engagement means at the terminal portion of the second end of said support arm for engaging one side of said hull and second hull engagement means spaced-apart from said first hull engagement means toward the first end of said support arm for engaging the opposing side of said hull, said second hull engagement means being further adapted to be urged toward the first end of said support arm and thereby to increase the width and decrease the height of said hull as desired to modify the lift capability thereof.

2. A portable outrigger assembly according to claim 1 wherein said inflatable hull defines a generally elongated teardrop shape with substantially conical terminal portions at the front and rear ends thereof, said front end being larger than said rear end of said hull.

3. A portable outrigger assembly according to claim 2 wherein said inflatable hull is attached to said support arm by said hull attachment means and secured substantially parallel to said boat and with the larger end thereof positioned as the leading end of said inflatable hull.

4. A portable outrigger assembly according to claim 2 wherein said inflatable hull is flexibly attached to said support arm by said hull attachment means so as to provide for limited pivotal movement about the axis of said support arm.

5. A portable outrigger assembly according to claim 2 wherein said inflatable hull comprises nylon fabric coated on at least one side with a sealant.

6. A portable outrigger assembly according to claim 1 wherein said support arm comprises aluminum tubing.

7. A portable outrigger assembly according to claim 6 wherein said aluminum tubing is 1.375 inches in outside diameter.

8. A portable outrigger assembly according to claim 6 wherein said tubing is connected to said boat by the first end thereof being connected to one end of an aluminum tube which is secured to said boat.

9. A portable outrigger assembly according to claim 8 wherein a second outrigger assembly is connected to the other end of said aluminum tube so as to provide an outrigger assembly on each of two opposing sides of said boat.

10. A portable outrigger assembly according to claim 1 wherein said first hull engagement means comprises a rope bridle fastened to the second end of said support arm and having two ropes diverging therefrom to engage said one side of said hull at two spaced-apart locations.

11. A portable outrigger assembly according to claim 1 wherein said second hull engagement means comprises two radially extending and pivotably movable arms secured to said support arm for engaging said other side of said hull at two spaced-apart locations, and a rope being connected to each of said arms and extending toward the first end of said support arm, whereby said arms may be pivotably urged toward said first end of said support arm by pulling said rope theretoward.

12. A portable outrigger assembly for a boat such as a kayak, sailboat and canoe comprising:

a. an inflatable hull;

b. support means for supporting said inflatable hull in spaced-apart relationship to said boat and comprising an elongate support arm having a first and second end, said support arm being adapted to be removably connected to said boat at the first end; and c. hull attachment means secured to the second end of said support arm and connected to said inflatable hull for securing sad inflatable hull to said support arm, said hull attachment means including means to selectively change the cross-sectional shape of said inflatable hull to modify the lift capability thereof comprising first hull engagement means at the terminal portion of the second end of said support arm for engaging one side of said hull and second hull engagement means spaced-apart from said first hull engagement means toward the first end of said support arm for engaging the opposing side of said hull, said second hull engagement means being further adapted to be urged outwardly from said hull to increase the width and decrease the height of said hull as desired to modify the lift capability thereof.

13. A portable outrigger assembly for a boat such as a kayak, sailboat and canoe comprising:

a. an inflatable hull;

b. tube means for supporting said inflatable hull in spaced-apart relationship to said boat and comprising a tube having a first and second end, said tube being adapted to be removably connected to said boat at the first end; and c. hull attachment means secured to the second end of said tube and connected to said inflatable hull for securing said inflatable hull to said tube, said hull attachment means comprising first hull engagement means at the terminal portion of the second end of said tube for engaging one side of said hull and second hull engagement means spacedapart from said first hull engagement means toward the first end of said tube for engaging the opposing side of said hull, said second hull engagement means being further adapted to be urged toward the first end of said tube and thereby to increase the width and decrease the height of said hull as desired to modify the lift capability thereof.

14. A portable outrigger assembly according to claim 13 wherein said inflatable hull defines a generally elongated teardrop shape with substantially conical terminal portions at the front and rear ends thereof, said front end being larger than said rear end of said hull.

15. A portable outrigger assembly according to claim 14 wherein said inflatable hull is attached to said tube by said hull attachment means and secured substantially parallel to said boat and with the larger end thereof positioned as the leading end of said inflatable hull.

16. A portable outrigger assembly according to claim 14 wherein said inflatable hull is flexibly attached to said tube by said hull attachment means so as to provide for limited pivotal movement about the axis of said tube.

17. A portable outrigger assembly according to claim 14 wherein said inflatable hull comprises nylon fabric coated on at least one side with a urethane sealant.

18. A portable outrigger assembly according to claim 13 wherein said tube comprises aluminum tubing.

19. A portable outrigger assembly according to claim 13 wherein said tube is connected to said boat by the first end thereof being connected to one end of a second tube of relatively shorter length which is secured to said boat.

20. A portable outrigger assembly according to claim 19 wherein a second outrigger assembly is connected to the other end of said second tube so as to provide an outrigger assembly on each of two opposing sides of said boat.

21. A portable outrigger assembly according to claim 13 wherein said first hull engagement means comprises a rope bridle fastened to the second end of said tube and having two ropes diverging therefrom to engage said one side of said hull at two spaced-apart locations.

22. A portable outrigger assembly according to claim 13 wherein said second hull engagement means comprises two radially extending and pivotably movable arms secured to said tube for engaging said other side of said hull at two spaced-apart locations, and a rope being connected to each of said arms and extending toward the first end of said tube, whereby said arms may be pivotably urged toward said first end of said tube by pulling said rope theretoward.

* * * * *